US007458334B2

(12) United States Patent
Baker

(10) Patent No.: US 7,458,334 B2
(45) Date of Patent: Dec. 2, 2008

(54) PORTABLE AND STOWABLE SAFETY DEVICE

(76) Inventor: Stephen J. Baker, 4100 Harbor Rd., Orange Beach, AL (US) 36561

( * ) Notice: Subject to any disclaimer, the term of this patent is extended or adjusted under 35 U.S.C. 154(b) by 0 days.

(21) Appl. No.: 11/651,390

(22) Filed: Jan. 9, 2007

(65) Prior Publication Data

US 2007/0125292 A1 Jun. 7, 2007

Related U.S. Application Data

(63) Continuation-in-part of application No. 11/288,044, filed on Nov. 28, 2005, which is a continuation-in-part of application No. 10/945,309, filed on Sep. 20, 2004, now Pat. No. 6,968,801, which is a continuation-in-part of application No. 10/684,848, filed on Oct. 14, 2003, now Pat. No. 6,792,887.

(51) Int. Cl.

| | |
|---|---|
| ***B63B 17/00*** | (2006.01) |
| *A62B 1/06* | (2006.01) |
| *E06C 1/52* | (2006.01) |
| *E06C 5/26* | (2006.01) |

(52) U.S. Cl. ..... 114/362; 114/343; 114/364; 182/70; 182/196

(58) Field of Classification Search ..... 114/362, 114/364, 343; 182/196, 70, 3, 4, 8, 62, 74, 182/92, 93, 151, 189, 190, 198, 199, 100
See application file for complete search history.

(56) References Cited

U.S. PATENT DOCUMENTS 2,651,789 A * 9/1953 Newland ..... 114/362
2,975,858 A * 3/1961 Billingsley ..... 182/196
4,926,965 A 5/1990 Fox
4,986,785 A 1/1991 Flowers
5,074,236 A * 12/1991 Robertson ..... 114/362
5,540,178 A 7/1996 Damron
5,542,369 A 8/1996 Ingram
5,704,447 A 1/1998 Doyle
5,848,667 A * 12/1998 Davidson ..... 182/190
6,343,562 B1 2/2002 Ingram (Continued)

*Primary Examiner*—Lars A Olson
*Assistant Examiner*—Daniel V Venne
(74) *Attorney, Agent, or Firm*—Bradley Arant Rose & White

(57) ABSTRACT

A safety device including a support that may be stowed within an enclosure and easily extended for use. One embodiment comprises a primary strap having a handle on one end and a step on the other end. The primary strap passes through two rings, which allow it to slide through the rings when pulled in one direction, but resist movement when pulled in the other. The rings are coupled to a keeper, preferably by a secondary strap, and the keeper includes a pouch closable by a flap to form an enclosure. The keeper may be attached to a vessel or other object via a connector, such as a loop, on its rear side. The straps are gathered inside the keeper, with a portion of the primary strap hanging outside the keeper and fixed in position by the closed flap, such when the portion of the primary strap is pulled, the flap will open and the handle and step extend, to allow a user to use the handle and step for support to gain entry to a vessel from the water or such other purpose as may be necessary or desirable.

12 Claims, 6 Drawing Sheets

U.S. PATENT DOCUMENTS 6,464,038 B1 10/2002 Park
6,533,626 B2 3/2003 Pons
2002/0119715 A1 8/2002 Pons

* cited by examiner

PORTABLE AND STOWABLE SAFETY DEVICE

PRIORITY CLAIM

This application is a continuation-in-part and claims priority to and the benefit of patent application Ser. No. 11/288,044, filed Nov. 28, 2005, which is a continuation in part of patent application Ser. No. 10/945,309, filed Sep. 20, 2004 now U.S. Pat. No. 6,968,801, which is a continuation-in-part of Ser. No. 10/684,848, filed Oct. 14, 2003 now U.S. Pat. No. 6,792,887.

BACKGROUND

The present invention provides a lightweight, stowable and extendable support to allow easy entry into a vessel by a person in the water, and for a variety of other uses. The invention is discussed and illustrated with respect to kayaks, but it may be used with virtually any water-borne vessel to which it may be secured.

Persons involved in sea kayaking, canoeing, sailing, or other boating activities may fall into the water, either intentionally or unintentionally. Depending on the conditions, such as current, wave level, water temperature, weather, and the like, it may be difficult to re-enter the vessel, and for some people with physical restrains or handicaps, or wearing heavy clothing or shoes, re-entry under any conditions may be difficult. Difficulty in re-entering a vessel from the water poses a safety issue and discourages some people from participating in these activities altogether.

A simple device to allow re-entry of a vessel from the water is needed. The device should satisfy various requirements of the marine environment and of the particular application in which it is used. For example, it should be durable and capable of withstanding water and sun. It should be stowable and secure, so that it does not interfere with other activities or objects on the vessel, such as paddling or lines and ropes on and extending from the vessel (e.g., ski ropes, anchor lines, fishing lines, etc.). It would also be advantageous if the device were lightweight, relatively inexpensive, and easy to use. In addition, it would be advantageous for the device to accommodate multiple straps and handles. It also would be helpful if the device were capable of attachment to personal flotation devices or any other sort of safety harness.

The embodiments of the present invention, as described and claimed herein, satisfy these needs and provide a stowable and extendable support that may be attached to virtually any vessel and which allows easy re-entry from the water into the vessel, as well as attachment to personal flotation devices, and may be used for a variety of other uses. The device thus increases safety and encourages participation in and the enjoyment of boating activities.

SUMMARY

One embodiment of the present invention is a stowable, adjustable length safety device comprising a primary strap having a handle at one end and a step at the other, a pair of rings through which the primary strap passes, such that the strap slides when pulled by the handle end and resists movement when pulled from the step end, and a keeper. The keeper comprises a pouch having an opening at its lower end which may be closed by folding a flap over the opening. The flap is releasably securable in the closed position by using VELCRO or the like. Typically, the device also will include a secondary strap, attached to the interior of the keeper at one end and to the pair of rings at the other. The keeper stows or houses the remaining components when they are not in use. The keeper also includes a connector, such as a flexible loop fixed to the back side of the pouch for securing the device to a person or object. Typically, the primary strap will include a pull loop attached to its step end, and the user will leave the pull loop protruding from the pouch when the other components are stowed inside with the flap in its closed position. When a user pulls on the exposed portion of the support loop, the flap releases and the strap(s), handle, and step, extend from the keeper.

DESCRIPTION OF DRAWINGS

These and other features, aspects, structures, advantages, and functions are shown or inherent in, and will become better understood with regard to, the following description and accompanied drawings where.

DETAILED DESCRIPTION

Figure 1:
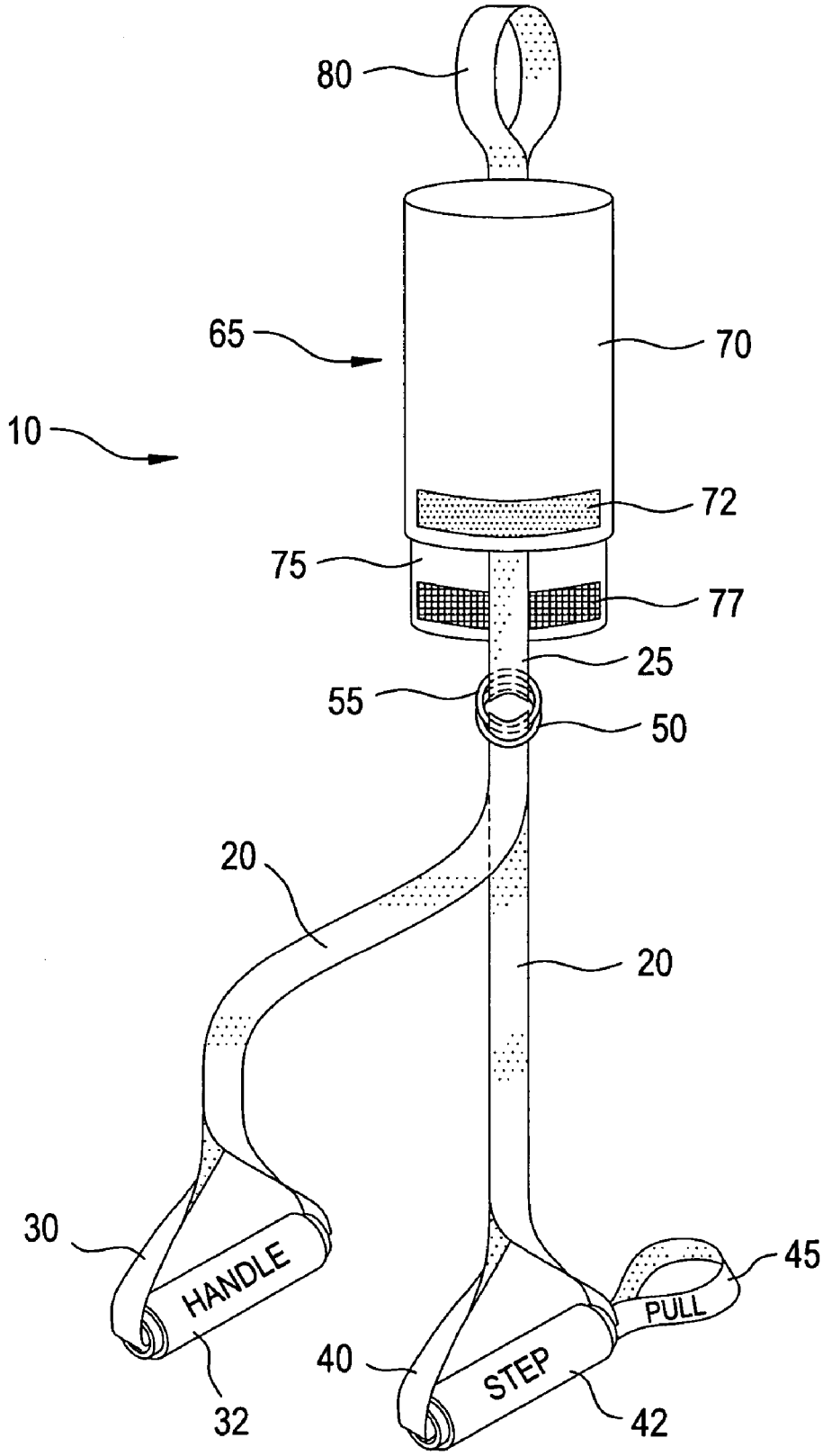
FIG. 1 is a perspective view of one embodiment of the present invention, with the strap extended and the keeper in an open configuration.
Figure 3A:
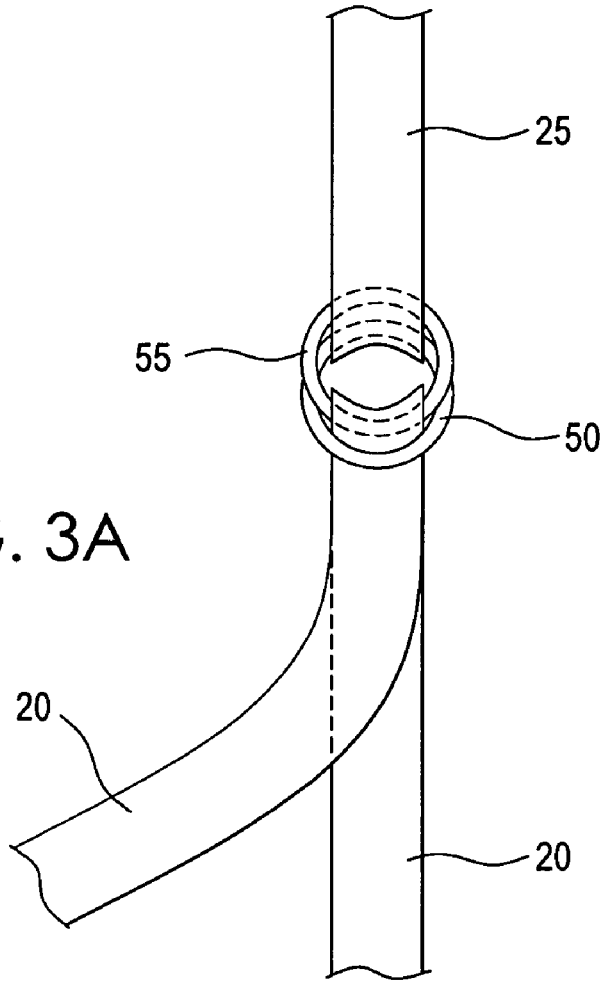
FIGS. 3A-B is a detailed view of one portion of the embodiment of FIG. 1.

As shown in FIG. 1, one embodiment of the safety device 10 of the present invention comprises a primary strap 20, with one end terminating in a handle 30 and the other end terminating in a step 40. The primary strap 20 passes through two rings 50 and 55, such that said primary strap 20 slides through the rings 50 and 55 when pulled from handle 30 and resists movement when pressure is placed on the step 40. This is shown in more detail in FIGS. 3A-B.

The device 10 also includes a keeper 65, which includes a pouch 70 and a connector 80 for securing the device to a person or object, such as a kayak. The pouch 70 has an opening at its lower end, as shown, and a flap 75 that is sized to fold over and close the opening. The flap 75 is releasable secured to the main body of the pouch 70 using releasable fasters such as VELCRO®, shown as items 72 and 77 in FIG. 1. The connector 80 is typically a closed loop of durable nylon webbing. However, it also may be simply two reinforced slots in the pouch through which a rope, line, ring, or carabineer may be passed, a carabineer or ring 81 otherwise attached to the pouch 70 (see FIG. 2B), or a short strap 82 sewn on either end to the pouch 70 to form a hold (see FIG. 2C), a hook, or any equivalent structure or mechanism allowing the keeper to be attached to another object. The connector 80 allows the device to be attached quickly and easily to a variety of objects, such as a cleat or handrail on a vessel, a strap or loop on a personal flotation device, a safety harness or virtually any object to which the user desires the safety device to be attached.

The rings 50 and 55 are coupled to the pouch 70, typically by a secondary strap 25. In such an embodiment, the one end of the secondary strap 25 is fixed to the interior of the pouch 70, and the other end passes through both of the rings 50 and 55. See FIGS. 3A-B. Alternatively, the rings 50 and 55 could be fixed directly to the interior or exterior of the pouch 70 by any conventional means.

Figure 3B:
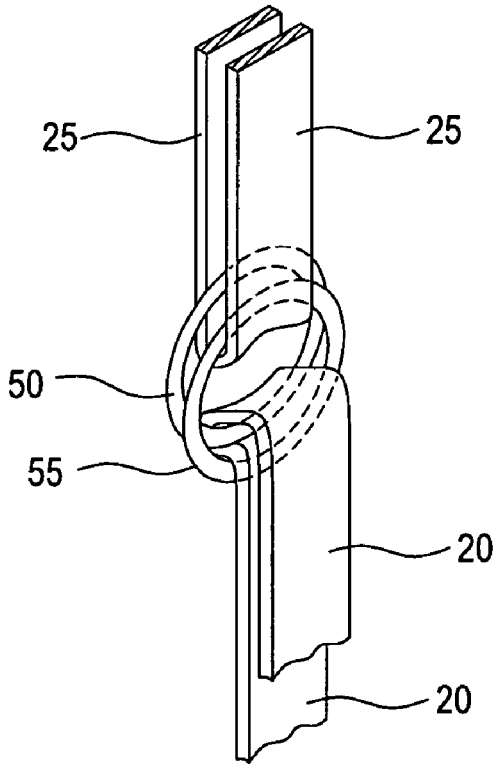

When the primary strap 20 is passed through the rings 50 and 55 as shown in FIG. 3B, the strap 20 slides when pulled from the handle end 30 but remains substantially fixed in position when pulled from the step end 40. Any other similarly functioning mechanism, regulating the movement of the strap in such a way to allow it to slide or move in response to force from one direction but resisting movement in response to force from the opposite direction, or to slide in one direction in response to a light force but to resist movement in response to a heavy force, could likewise be employed. A ratcheting device such as found in automotive seatbelt applications, permitting the belt to extend unless pulled upon with a given force, could be used. Likewise, certain belay devices used in rock climbing, which permit rope to slide through a cam in one direction but not another, or to slide until pulled with sufficient force could likewise be used. One such device is known as a "gri-gri."

However, it has been found that the rings 50 and 55 are simplest, most reliable, and least expensive way to accomplish the desired result. Although any substantially rigid, durable, and strong material could be used, the rings 50 and 55 are preferably made of stainless steel to resist the marine environment. Further, if the primary strap 20 is fully extended in the handle direction, the strap, if no force is applied to either end, can be manually fed back through the rings 50 and 55 to reset the length of the strap extending from each side of the rings to a desired length.

The primary and secondary straps 20 and 25 may be constructed of any suitably strong and durable material, preferably capable of maintaining its strength and longevity in a wet environment. Commonly available nylon webbing is adequate. The keeper 65 may be constructed of any material suited for the intended application, such as durable nylon fabric or heavy-duty vinyl. It could be constructed of a mesh material. The keeper 65 may be of any suitable shape, polygonal, circular, or irregular, depending on the needs and preferences of a user or a particular application. Like all other components of the device, the keeper 65 may be of any desirable color and may include reflective highlights. Further, the keeper 65 may be constructed to comprise some amount of hydrophobic foam or low density material such that it floats.

In a typical embodiment, the handle 30 and step 40 will include tubular grips 32 and 42 as shown in FIG. 1. The respective ends of the primary strap may simply be passed through these grips before they are fixed into a loop configuration to form the handle 30 and step 40. The tubular grips may be constructed of any desired material, such as a plastic, polymer, foam, or rubber-type material. A foam or polymer grip may be used to improve ergonomics and reduce slippage in the water, or be designed such that the grip floats. In other applications, it may be desirable to construct the grips from metal, such as aluminum or stainless steel for higher durability. The grips may be designed to be removable.

It should be noted that the handle 30 and step 40 may be formed by any technique or material known in the art. A simple loop of the primary strap 20 may suffice, or rigid members of any shape (rings, triangular, T-shaped, etc.) may be attached to the ends of the primary strap 20 to form a handle 30 and a step 40. In a preferred embodiment, a pull loop 45 is attached to the step 40, as shown in FIG. 1, but it also could be attached to the handle 30.

Figure 2A:
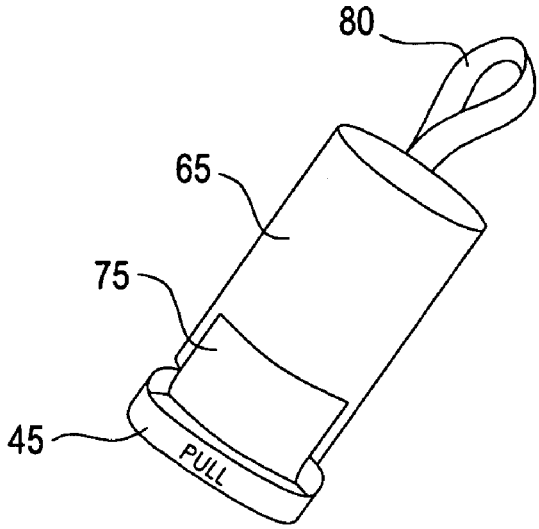
FIG. 2A is the embodiment of FIG. 1 with the strap and the keeper in a closed, stowed configuration.
Figure 2B:
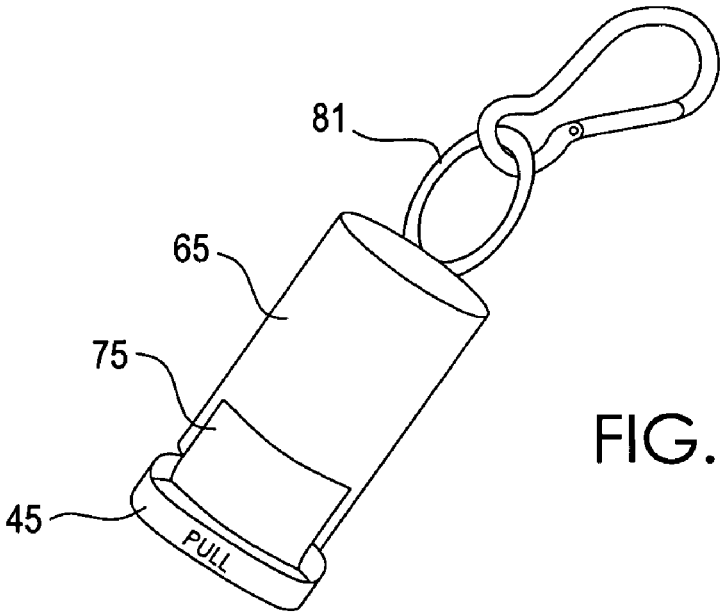
FIGS. 2B-C are alternate embodiments of the present invention, utilizing different connectors than that shown in FIG. 1.
Figure 2C:
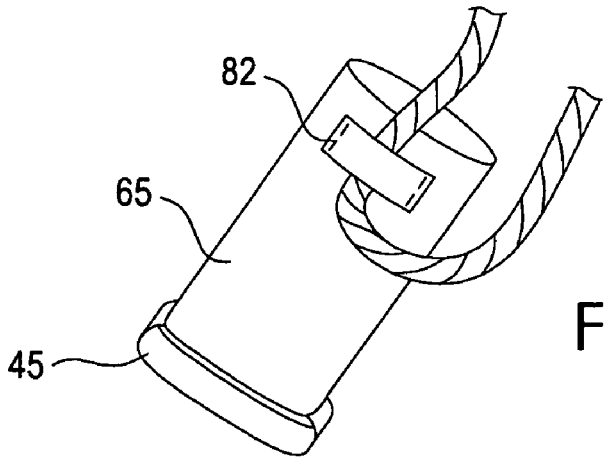

In operation, the primary strap 20, the secondary strap 25 (if included in the embodiment), the rings 50 and 55, and the handles 30 and 40 (grips 32 and 42 if included in the embodiment) are gathered within the keeper 65, with the flap 75 shut, with a portion of the primary strap 20 extending outside. Preferrably, a pull loop 45 is utilized, and the pull loop 45 extends out of the keeper, as shown in FIG. 2.

Figure 4:
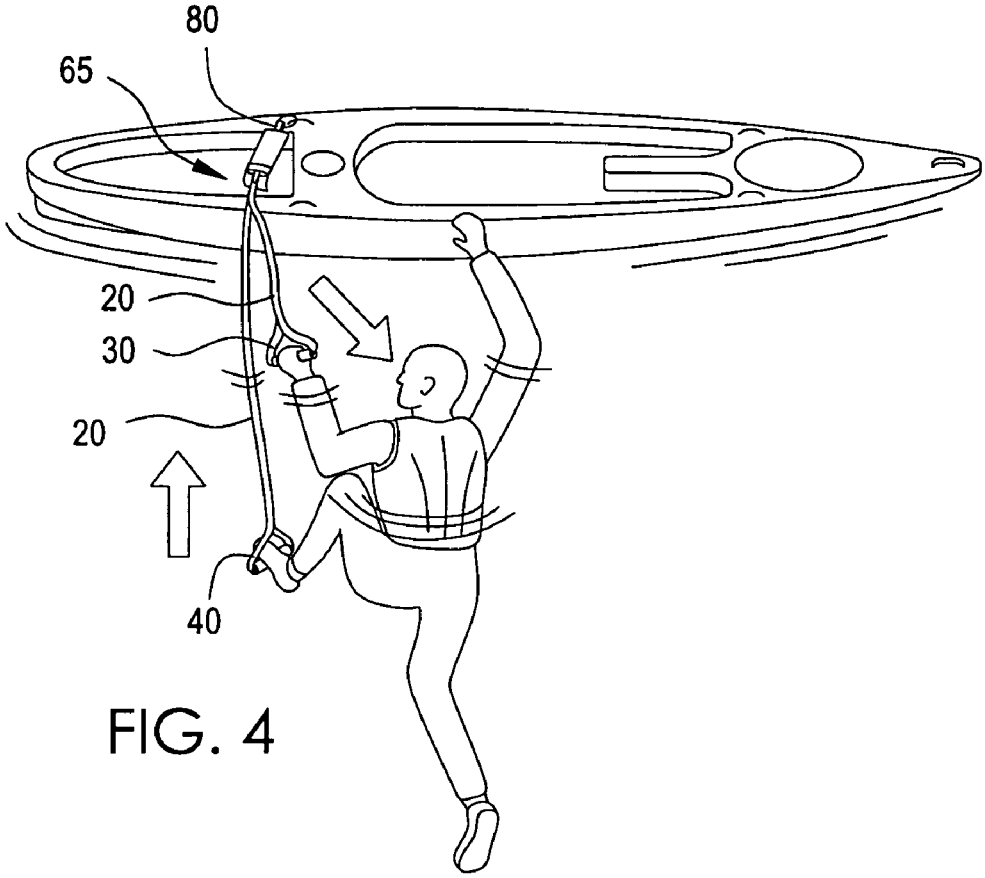
FIG. 4 is a perspective view of an embodiment of the present invention in use, in its open, extended configuration, with the kayaker grabbing the handle and having put his foot in place on the step and preparing to board the vessel.

In a typical situation, a user will be in the water when the device 10 is used, as shown in FIG. 4. When the user pull loop is pulled, the releasable fasteners 72 and 77, holding the flap 75 closed, release and the primary strap 20, the secondary strap 25 (if included in the embodiment), the rings 50 and 55, and the handles 30 and 40 (grips 32 and 42 if included in the embodiment) deploy from the pouch. As noted above, the rings 50 and 55 allow the primary strap 50 to resist movement when pulled from the step direction (and thus it is preferable to include the pull loop 45 on the step end). With the device 10 fixed to a vessel via connector 80 as shown in FIG. 4, the user can thus step onto the step 40 (or grip 42) and push off the step 40 to regain entry to the vessel. The user can adjust the position of the step 40 in the water, to optimize for his or her height, by pulling the primary strap 25 from the handle end 30. This allows the length of the primary strap 25 on the step side to shorten, thus placing the step 40 closer to the vessel. The user may repeat this process as needed to gain entry to the vessel. Further, with the user's body weight primarily bearing on the step 40, the user can grasp the handle 30 for stability and assistance as he or she boards the vessel.

Figure 5:
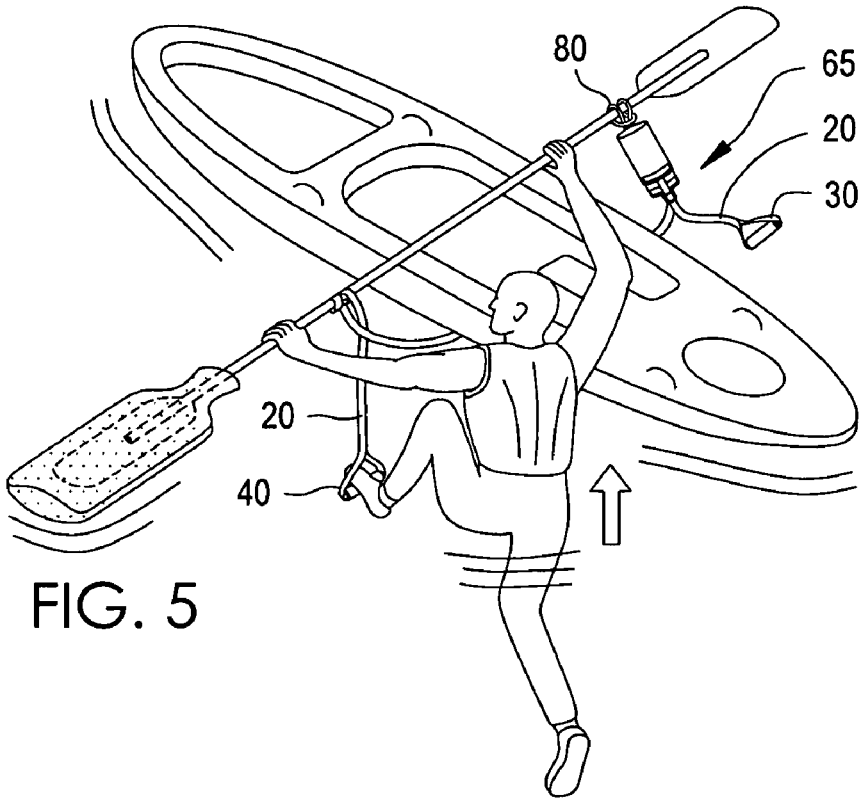
FIGS. 5-7 show alternate means of using the embodiment of FIG. 1, in conjunction with a paddle and/or a second person, to board a vessel.
Figure 6:
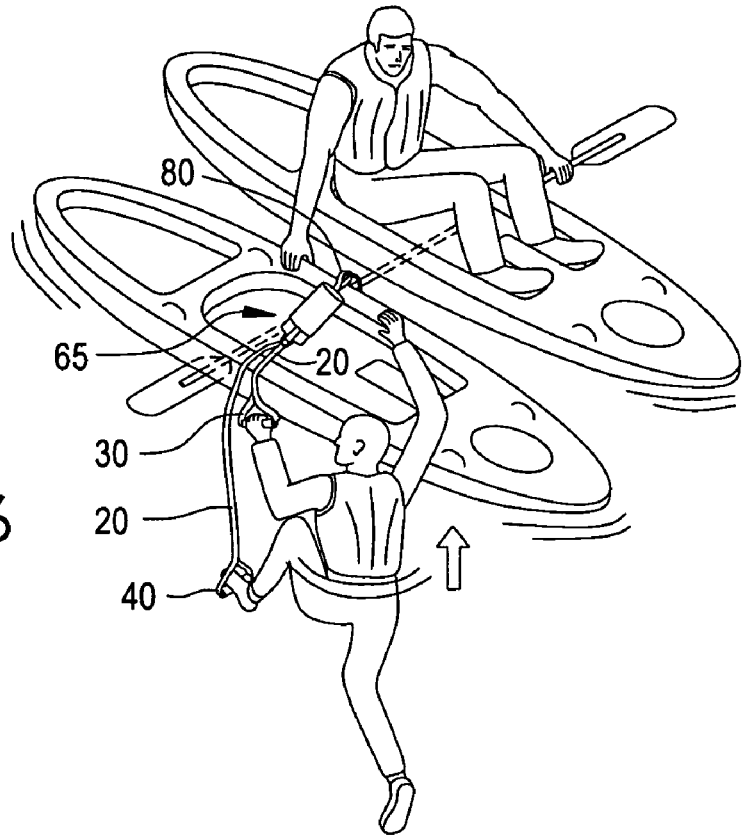
Figure 7:
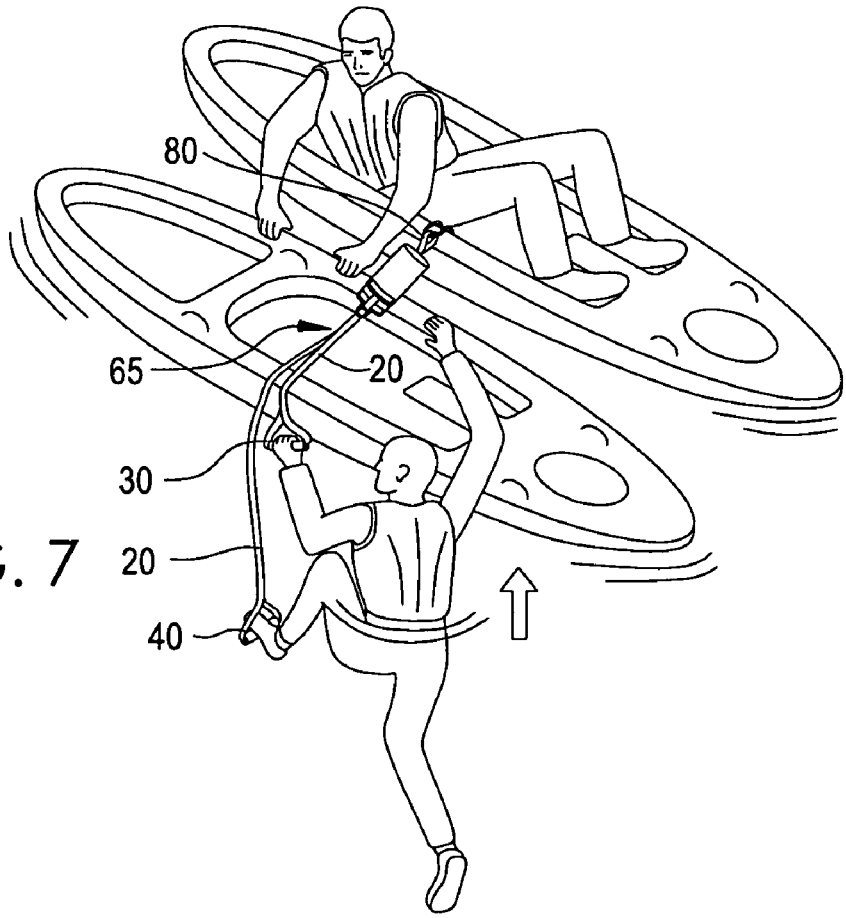
Figure 8:
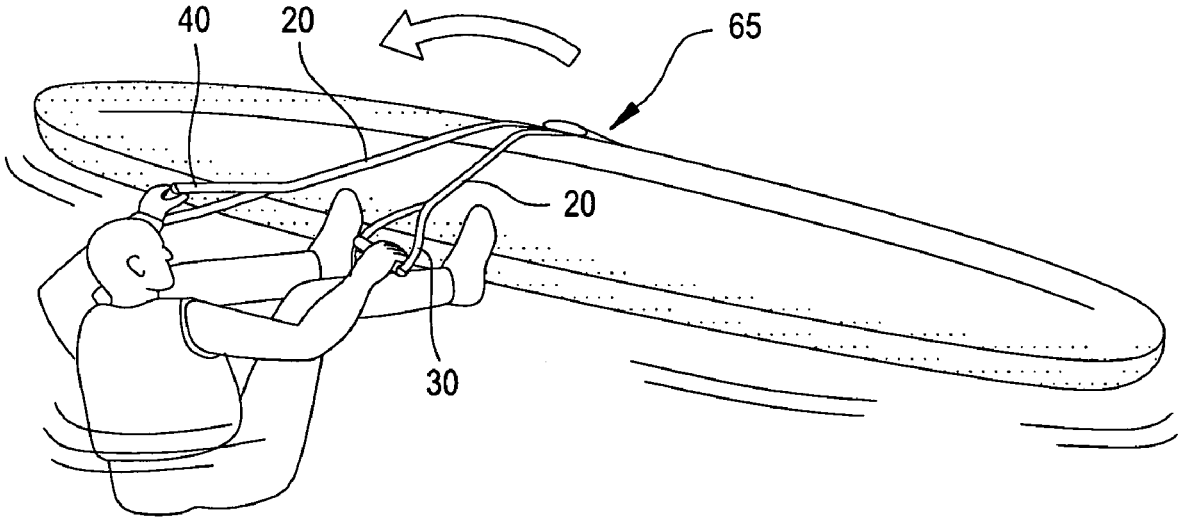
FIG. 8 shows the embodiment of FIG. 1 used to right an overturned vessel.

The device 10 can also be used in conjunction with a paddle, as shown in FIG. 5, to gain entry to a vessel. This technique is especially useful were the vessel has a high tendency to roll. Another entry technique, using the device 10, is illustrated in FIG. 6, in which the device is used in conjunction with a paddle and a second person and vessel. In FIG. 7, the device is used in conjunction with a second person and vessel to board the craft. FIG. 8 shows the device used to right an overturned vessel.

The portable, stowable safety device thus described and illustrated provides an easy-to-use, readily accessible way for almost any person to enter a vessel, such as a kayak, from the water. In addition, an overboard person can simply hold onto the support to prevent being separated from the vessel. The device may be secured to a personal flotation device or paddle to allow a rescuer to have a ready and easy hand-hold on a person in the water. This device thus makes boating safer and more enjoyable for individuals, especially those with disabilities, who would otherwise be unable to regain entry into the vessel from the water. Further, the device is lightweight and portable, and thus may easily be moved from one vessel to another, or from one personal flotation device to another. It may be used on virtually any type of watercraft, including kayaks, ocean kayaks, canoes, ski boats, fishing boats, sailboats, party or pontoon boats, life boats, white-water rafts and other rafts, and any other vessel or object to which the safety device may be secured.

The uses of the device as claimed should not be restricted to water or marine-based uses. For example, the device could be configured for use as a stowable fire escape ladder for residential use, or as a ladder for hunters to use in accessing deer stands.

Although the present invention has been described and shown in considerable detail with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A safety device comprising:

a primary strap, with a handle end and a step end, the handle end comprising a handle and the step end comprising a step;

two rings, said primary strap passing through said rings such that said primary strap slides through said rings when pulled from the handle end and resists movement when pulled from the step end;

a keeper, said rings coupled to said keeper, said keeper comprising a pouch having an opening that may be releasably closed, said pouch being of sufficient size to stow said primary strap inside with at least a portion of said primary strap protruding from said opening in a position fixed by the closure thereof; and a connector for securing said keeper to a person or object.

2. The device of claim 1, further comprising a secondary strap for coupling said rings to said keeper, one end of said secondary strap being fixed to said keeper and the other end of said secondary strap forming a fixed loop passing through said rings.

3. The device of claim 1, wherein said connector is selected from the group consisting of a flexible loop, a rigid ring, a carabiner, and a strap having two ends with each said end fixed to said keeper.

4. The device of claim 1, wherein said keeper further comprises a flap that may foldable and releasably secured over said opening.

5. The device of claim 1, wherein said handle comprises a closed loop of said primary strap at its handle end, and said step comprises a closed loop of said primary strap at its step end.

6. The device of claim 5, further comprising two tubular grips, the closed loop of said handle end passing through the first of said tubular grips, and the closed loop of said step end passing through the second of said tubular grips.

7. The device of claim 6, wherein the word "HANDLE" is written upon the first of said tubular grips and the word "STEP" is written upon the second of said tubular grips.

8. The device of claim 1, wherein said step comprises the word "STEP"written thereon, and said handle comprises the word "HANDLE" written thereon.

9. The device of claim 1, wherein said primary strap further comprises a pull loop attached to said step end.

10. The device of claim 1, wherein said primary strap further comprises a pull loop attached to said handle end.

11. A safety device comprising:

a primary strap, with a handle end and a step end, the handle end comprising a handle comprising a closed loop of said primary strap at its handled end and the step end comprising a step comprising a closed loop of said primary strap at its step end, said primary strap passing through means for regulating the movement of said primary strap in response to forces pulling said primary strap from either end thereof a keeper, said regulating means being coupled to said keeper, said keeper comprising a pouch having at its lower end an opening and a flap foldable and releasably securable over said opening, said pouch being of sufficient size to stow said primary strap inside with at least a portion of said primary strap protruding from said opening in a position fixed by the closure of said flap; and securing means for securing said keeper to a person or object.

12. The device of claim 11, further comprising two tubular grips, the closed loop of said handle end passing through the first of said tubular grips, and the closed loop of said step end passing through the second of said tubular grips.

* * * * *